US005358687A

United States Patent [19]

Ichikawa et al.

[11] Patent Number: 5,358,687

[45] Date of Patent: Oct. 25, 1994

[54] PROCESSES FOR MANUFACTURING INTERMETALLIC COMPOUNDS, INTERMETALLIC ALLOYS AND INTERMETALLIC MATRIX COMPOSITE MATERIALS MADE THEREOF

[75] Inventors: Kiyoshi Ichikawa; Yoshiji Kinoshita, both of Tsukuba; Satoshi Ishizuka, Hamamatsu, all of Japan

[73] Assignees: Agency of Industrial Science and Technology, Tokyo; Suzuki Motor Corporation, Hamamatsu, both of Japan

[21] Appl. No.: 79,369

[22] Filed: Jun. 21, 1993

[51] Int. Cl.[5] ..... C01G 15/00

[52] U.S. Cl. ..... 420/590

[58] Field of Search ..... 420/590

[56] References Cited

U.S. PATENT DOCUMENTS 3,777,009 12/1974 Menashi ..... 420/590
4,265,661 5/1981 Ware ..... 420/590
4,668,470 5/1987 Gilman ..... 420/590
4,792,431 12/1988 Eckert ..... 420/590

*Primary Examiner*—Peter D. Rosenberg
*Attorney, Agent, or Firm*—Oblon, Spivak, McClelland, Maier & Neustadt

[57] ABSTRACT

In manufacturing an intermetallic compound or an alloy based thereon having a fine-grained microstructure by stirring a charge of components, the high strain energy built up in the charge is released to prevent the occurrence of cracks in the course of cooling to room temperature. The charge is melted by high-frequency heating in an inert atmosphere. The molten charge is transferred into an isothermal furnace filled with the same atmosphere. The solidifying charge is stirred to break the formed crystals and thus forming a homogeneous fine-grained microstructure. After continuing stirring for a given time, the charge with refind microstructure is returned into the high-frequency furnace for reheating to release the high strain energy built up in it.

10 Claims, 5 Drawing Sheets

5μm

5μm

5μm

100μm

100μm

100μm

100μm

50μm

PROCESSES FOR MANUFACTURING INTERMETALLIC COMPOUNDS, INTERMETALLIC ALLOYS AND INTERMETALLIC MATRIX COMPOSITE MATERIALS MADE THEREOF

FIELD OF THE INVENTION

This invention relates to processes for manufacturing intermetallic matrix compounds, intermetallic alloys and intermetallic matrix composite materials made thereof.

DESCRIPTION OF THE PRIOR ART

With ordinary metals perfect microstructure can be obtained by simply stirring and solidifying them in liquid form, as by the process and apparatus proposed by the Inventor in U.S. Pat. No. 4,636,355.

The process proposed by the Inventor prepares a molten alloy in a crucible placed in an evacuated container. A stirring rod inserted into the crucible slowly stirs the liquid alloy in its cooling process. The stirring speed is increased when the liquid alloy has cooled substantially to a temperature at which solidification begins. By continuing ultrahigh-speed stirring until the temperature drops to a point where solidification is completed, a fine-grained alloy exhibiting a superplasticity.

If intermetallic compounds having perfect crystallographic structures are just stirred and allowed to solidify, the likelihood of cracks occurring in the course of cooling to ordinary temperature is very strong. To prevent such crack formation in the course of cooling, some measure must be taken to release the high energy stored in such compounds. The same applies to composite materials prepared by adding strengthening agents to intermetallic compounds.

SUMMARY OF THE INVENTION

The primary object of this invention is to provide simple processes to allow the manufacture of intermetallic compounds, alloys based on intermetallic compounds and intermetallic matrix composite materials prepared by strengthening intermetallic compounds having perfect microstructures with simple processes of stirring during solidification by preventing the formation of cracks in the course of cooling to room temperature by releasing the high energy stored in them.

To achieve the above object, a manufacturing process according to this invention prepares a molten intermetallic compound or intermetallic-compound-based alloy in a high-frequency furnace filled with a vacuum or inert atmosphere, transfers the molten compound or alloy into an isothermal furnace filled with the same atmosphere where the solidifying compound or alloy is rapidly stirred with a rotating stirrer to form a homogeneous fine-grained microstructure by breaking formed crystals, and returns the stirred compound or alloy into the high-frequency furnace after a given time to release the high strain energy built up therein by applying high-frequency heating again.

A process to manufacture an intermetallic matrix composite material according to this invention adds a step to the process just described in which a dispersion strengthening agent is added to an intermetallic compound or an alloy based thereon when their materials are put in the high-frequency furnace or before they are stirred and allowed to solidify in the isothermal furnace.

The processes according to this invention are applicable to the manufacture of TiAl, $Ti_3Al$, $Al_3Ti$, $Nb_3Al$, $Nb_2Al$, NiAl, $Ni_3Al$, $Co_3Al$, $Co_2Nb$, $Mo_5Si_3$, $Cr_3Si$, $Cr_2Nb$, FeAl, $Al_3V$, $Al_3Nb$, $Al_3Zr$, $Mo_3Al_8$, $MoSi_2$, $Ti_5Si_3$, $Nb_5Si_3$, $Nb_2Be_{17}$, and $ZrBe_{13}$ and alloys based on them. The processes are also applicable to many other types of intermetallic compounds, alloys based on them, and intermetallic matrix composite materials prepared from such compounds and alloys.

For the manufacturing of intermetallic matrix composite materials, common strengthening agents such as particles or short fibers of VB, $TAB_2$, $TiB_2$, TiC, WC, NbC, VC, TaC, ZrC, SiC, $Al_2O_3$, $Y_2O_3$, $ThO_2$, AlN, BN and TiN can be used.

The essential requirement for the strengthening agents is to form a relatively smooth interface with the matrix of intermetallic compounds and alloys based thereon. It is especially desirable that crystal structures of a matrix and an addition are similar each other or the same crystal structure. The appropriate addition of the strengthening agents is generally in the range of 0.1 vol % to 70 vol % of the total volume of the intermetallic matrix composite.

To break the formed crystals to obtain a homogeneous fine-grained microstructure, the intermetallic compounds or alloys based thereon must generally be stirred at a high speed for a period of 0.1 minute to 10 minutes during the solidification. The stirred compound or alloy returned into the high-frequency furnace should be reheated at a temperature above 500 ° C. below their solidification temperature. To ensure the release of the high internal strain energy and prevention of crack formation in the cooling process, such re-heating must be continued for a period of 10 to 10000 minutes.

DESCRIPTION OF THE PREFERRED EMBODIMENTS

Referring now to the apparatus shown in FIG. 1, details of the processes according to this invention will be discussed below.

Figure 1:
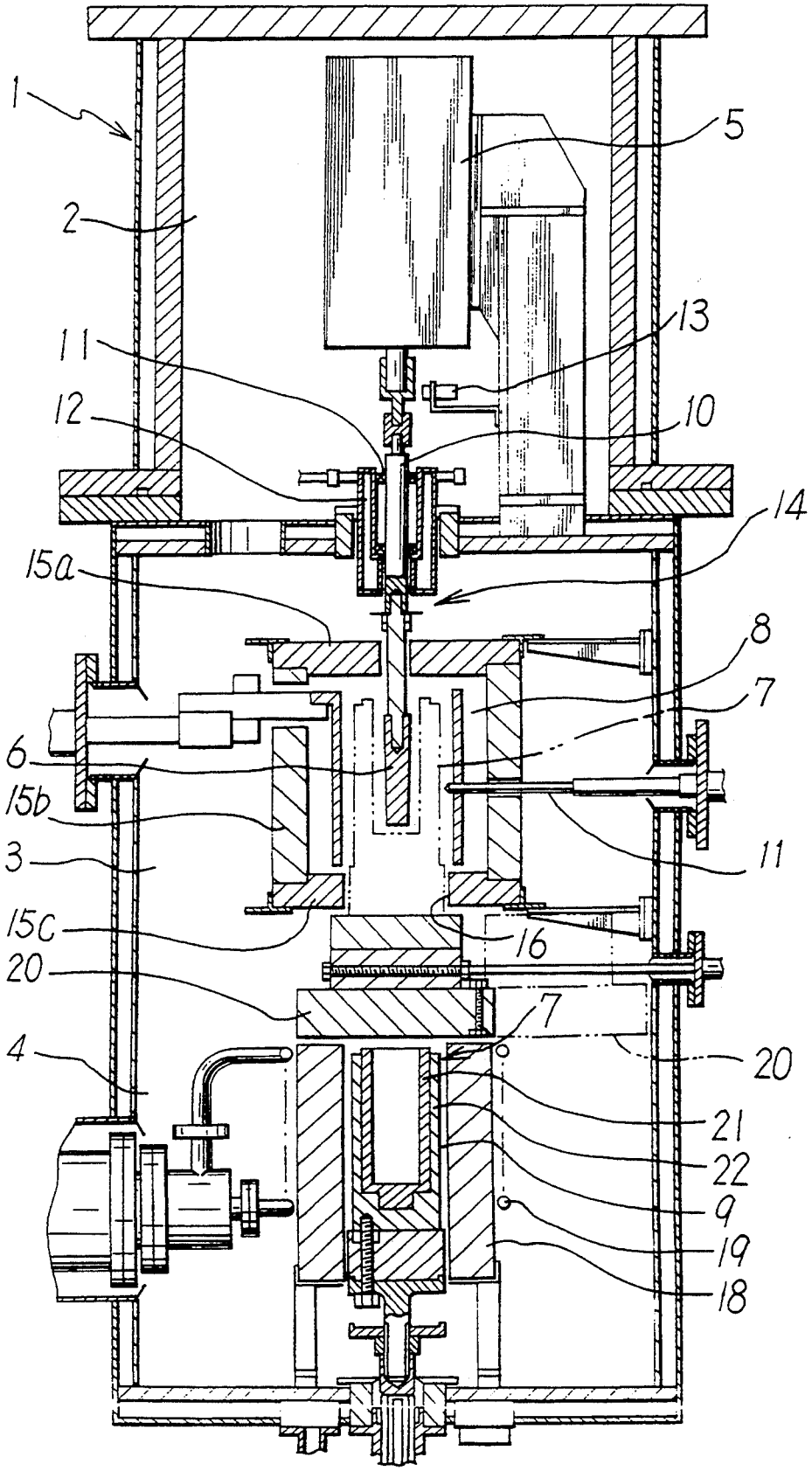
FIG. 1 is a cross-sectional view of an apparatus for implementing a process according to this invention.

The apparatus shown in FIG. 1 comprises an isothermal furnace filled with a vacuum or an inert atmosphere to hold an intermetallic compound or an alloy based thereon and a stirrer that forms a homogeneous fine-grained microstructure by breaking the crystals of the solidifying compound or alloy by stirring at a high speed of up to approximately 5000 rpm. The compound or alloy thus stirred for a given time is then transferred into a high-frequency furnace for reheating. The high-frequency heating applied again releases the high strain energy built up in the compound or alloy by forced stirring, thereby preventing the occurrence of cracks therein in the course of cooling.

To be more specific, the apparatus shown in FIG. 1 comprises a chamber proper 1 having a hinged door that constitutes a vacuum container. The chamber proper 1 is segmented into an upper motor chamber 2 to hold a motor 5 to rotate a stirrer 6 that stirs a solidifying intermetallic compound or an alloy based thereon, a middle solidification chamber 3 having an isothermal furnace 8 containing a crucible 7 to hold the solidifying compound or alloy to be stirred, and a lower melting chamber 4 having a high-frequency furnace 9 for heating the stirred compound or alloy with a high-frequency current. Though not shown, the chamber proper 1 is connected to a vacuum exhauster and a gas intake to introduce an inert gas.

The upper motor chamber 2 holds the motor 5 whose output shaft 10 is supported by a bearing 11 on a water cooler 12 mounted on a partition between the motor chamber 2 and the middle solidification chamber 3. A rotation sensor 13 is attached to the output shaft 10 of the motor 5.

If the motor 5 is placed outside the vacuum chamber proper 1, the output shaft 10 of the motor 5 must be passed inside through the wall of the vacuum chamber proper 1 to rotate the stirrer 6 inserted in the molten compound or alloy at a high speed. With this construction, the material to seal a hole through which the output shaft 10 is passed must be replaced frequently as it is subjected to a heavy load. The construction according to this invention solves this problem by placing the motor 5 inside the vacuum chamber proper 1.

The middle solidification chamber 3 contains the isothermal furnace 8 (a resistance-heating furnace) to keep the compound or alloy at a constant temperature. The isothermal furnace 8 covered with heat insulators 15*a* to 15*c* contains a heater 16 therein.

The heat insulator 15*a* at the top of the isothermal furnace 8 has a hole pass through the output shaft 10 of the motor in the center thereof. To the lower end of the output shaft 10 in the isothermal furnace 8 is attached a metal stirrer 6 having an octagonal cross-section that is thus rotated by the motor 5.

The stirrer 6 is made of either the intermetallic compound or alloy based thereon to be stirred thereby or one of the component elements (a pure metal) thereof. Thus, even if part of the stirrer 6 erodes, the compound or alloy remains uncontaminated, with the composition thereof appropriately controlled by the adjustment of component concentrations.

The isothermal furnace 8 also admits the crucible 7 through an opening 16 in the heat insulator 15*c* at the bottom thereof. A thermocouple 17 is passed inside through the heat insulator 15*b* on the side thereof.

Reference numeral 14 designates an endoscope to visualize the inside of the crucible 7 through a peep hole.

The lower melting chamber 4 contains a high-frequency furnace 9 to heat the intermetallic compound or alloy based thereon with a high-frequency current whose side is covered with a heat insulator 18. A high-frequency coil 19 is wound around the insulator 18. A crucible cover 20 that can be opened and closed from outside is mounted on the high-frequency furnace 9.

Under the high-frequency furnace 9 is provided an elevating mechanism (not shown) that moves the crucible 7 up and down. The elevating mechanism selectively moves the crucible 7 between the high-frequency furnace 9 and the isothermal furnace 8. With the crucible cover 20 kept in the opened position, the elevating mechanism moves the crucible 7 up into the isothermal furnace 8.

The crucible 7 consists of an inner crucible of calcia 21 and an outer crucible of graphite 22.

The crucible 7 containing the ingredients to make a desired intermetallic compound or an alloy based thereon is placed in the high-frequency furnace 9. An inert gas is introduced into the vacuum chamber proper 1 that has been evacuated. To make an intermetallic matrix compositematerial, the requisite amount of strengthening agent is added to the composition of the compound or alloy charged into the crucible.

When the gas pressure in the high-frequency furnace 9 reaches the desired level, the ingredients are melted in a short time in a vacuum or inert atmosphere by high-frequency heating. By then opening the crucible cover 20 above the high-frequency furnace, the elevating mechanism raises the crucible 7 containing the molten charge into the isothermal furnace 8 filled with the same atmosphere. The rotating stirrer 6 stirs the molten charge in the isothermal furnace 8, with the rotating speed gradually increased to the desired level.

By continuing stirring at a constant high speed, the crystals formed in the molten charge are broken to realize a homogeneous fine-grained microstructure. When stirring is complete, the elevating mechanism is actuated to lower the crucible 7 back into the high-frequency furnace 9, thereby preventing the deposition of the semi-solid charge on the stirrer 6. Reheating in the high-frequency furnace 9 releases the high strain energy built up in the charge by the forced stirring, which, in turn, prevents the occurrence of cracks in the cooling process of the obtained intermetallic compound or alloy based thereon.

A desired intermetallic matrix composite material can be obtained by adding a strengthening agent to the composition of the intermetallic compound or alloy based thereon prior to the stirring process described above. Addition of a strengthening agent should preferably be made by either of the following two methods.

One method needs a container to hold the requisite amount of a strengthening agent in the solidification chamber 3 and a hopper externally actuated charger to charge the strengthening agent from the container into the crucible 7. The other method is to melt the components of a desired intermetallic compound or alloy based thereon charged in the calcia crucible in the heating furnace together with a strengthening agent.

In manufacturing an intermetallic compound, an alloy based on such a compound or an intermetallic matrix composite material thereof having a perfect microstructure by simply stirring a solidifying molten mixture of components, the processes according to this invention prevents the occurrence of cracks in the course of cooling to room temperature by releasing the high strain energy built up therein by means of the second high-frequency heating.

Now an example of an intermetallic-compound-based alloy (Ti-44 at % Al alloy) manufactured using the apparatus shown in FIG. 1 is described below.

EXAMPLE 1

The apparatus was equipped with a 2.2 horsepower motor 5 having a capacity to rotate the stirrer 6 at a speed of up to 5000 rpm. The rotating speed of the motor was measured by the rotation sensor 13 attached to the output shaft 10 thereof and recorded by a digital meter. The actual temperature of the charge was derived from the relation between the temperature measured at the center of the outer wall of the graphite crucible 22 with a radiation pyrometer and the temperature determined by the direct observation of the charge through the peep hole.

The stirrer 6 made of pure titanium had a downwardly tapering octagonal cross-section, an upper base with a major axis of 38 mm and a minor axis of 30 mm, a lower base with a major axis of 32 mm and a minor axis of 25 mm, and a length of 120 mm.

To obtain a Ti-44 at % Al alloy, a mixture of granular sponge titanium of not lower than 99.5% purity and small pieces of aluminum of 99.99% purity weighing approximately 380 g in total was processed in the crucible 21 of calcia having an inside diameter of 55 mm, an outside diameter of 83 mm and a depth of 130 mm.

After placing the crucible containing the mixed specimen in the high-frequency furnace 9, the vacuum chamber proper 1 was evacuated to $1\times10^{-5}$ torr or below. Then, argon gas was introduced therein as the inert gas until the pressure inside became approximately 800 torr. Then, the specimen was melted in a short time by applying high-frequency heating.

The melting of the specimen was confirmed by determining, using a radiation pyrometer, that the temperature of the side wall of the outer crucible of graphite covering the inner crucible of calcia placed in the lower high-frequency furnace 9 in the vacuum chamber proper 1 reached 1100° .

At this point, the crucible cover 20 above the high-frequency furnace 9 was opened to confirm that the specimen has melted by means of the endoscope. Then, the elevating mechanism was actuated to raise the crucible 7 containing the molten specimen into the isothermal furnace 8 where the stirrer 6 of pure titanium was put into the molten specimen. The ascent of the crucible was stopped when the lower end of the stirrer 6 reached a point 10 mm above the inner bottom thereof.

Then, the stirrer 6 was rotated, at a relatively low speed of approximately 900 rpm in the beginning and then with gradually increased speeds until the start of solidification. The rotating speed of the stirrer in the initial stage of solidification was increased not rapidly but at a steady rate to prevent the spatter of the solidifying specimen to the outside of the crucible 7. The constant rotating speed of the stirrer during solidification varied from 900 rpm 5000 rpm.

After continuing the constant-speed stirring for a given period of time, the elevating mechanism was actuated to lower the crucible into the high-frequency furnace 9 at a point between the later stage and completion of solidification, thereby preventing the deposition of the same-solid specimen on the stirrer 6. The specimen in the high-frequency furnace 9 was then again subjected to high-frequency heating at 1000° C. for approximately 10 minutes.

For the purpose of comparison, a reference specimen was prepared by allowing the molten charge to solidify spontaneously in the isothermal furnace 8 without using the stirrer.

Figure 2:
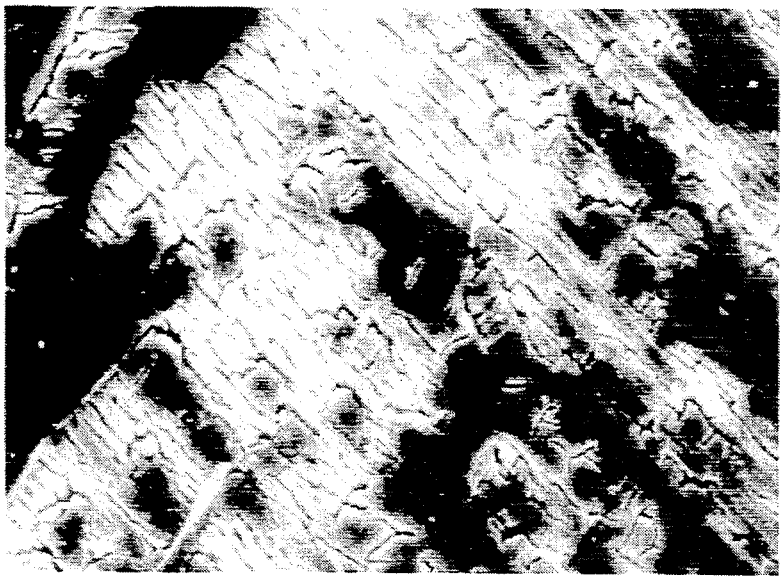
FIG. 2 is a photomicrograph of the solidified microstructure of a Ti-44 at % Al alloy prepared by a conventional process in an argon atmosphere at 800 torr.

FIG. 2 shows a photomicrograph of the solidified microstructure of the reference specimen (for comparison) of a Ti-44 at % Al alloy prepared by a conventional process from a charge melted in an argon atmosphere at 800 torr. Lamellar structures of TiAl and $Ti_3Al$ were obviously observed.

Figure 3:
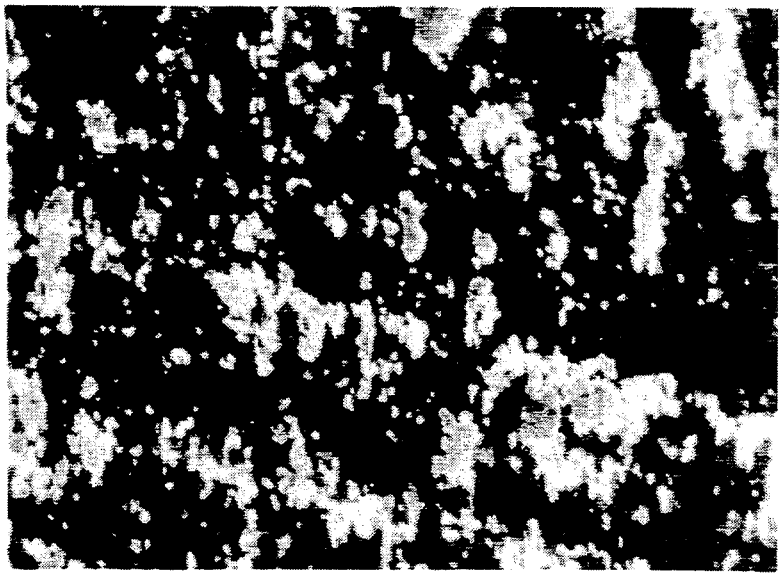
FIG. 3 is a photomicrograph of the microstructure of a Ti-44 at % Al alloy prepared in an argon atmosphere at 800 torr and allowed to solidify while being stirred with a stirrer rotating at a speed of 900 rpm.

FIG. 3 shows a photomicrograph of the microstructure of a Ti-44 at % Al alloy prepared from the same charge melted in an argon atmosphere at 800 torr and stirred at varying speeds increased up to the final one of 900 rpm. After the stirrer has been placed in position, stirring was continued for 30 seconds. Then, the crucible was immediately lowered to prevent the deposition of the molten specimen on the stirrer.

Figure 4:
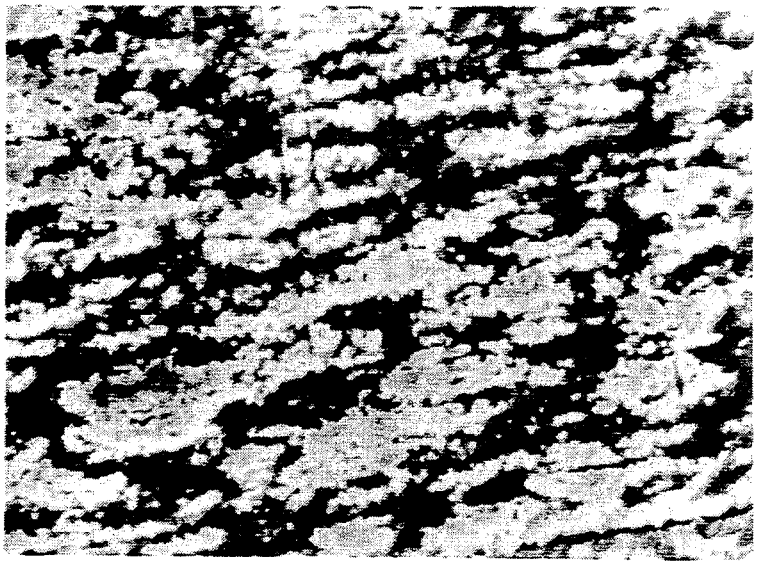
FIG. 4 is a photomicrograph of the microstructure of a Ti-44 at % Al alloy prepared in the same atmosphere and allowed to solidify while being stirred with a stirrer rotating at a speed of 4200 rpm.

FIG. 4 shows a photomicrograph of the microstructure of a Ti-44 at % Al alloy prepared from the same charge melted in an argon atmosphere at 800 torr and stirred at a speed of 4200 rpm. After continuing stirring for 20 seconds, the crucible was immediately lowered to prevent the deposition of the semisolid specimen on the stirrer.

In the specimen shown in FIG. 3 was observed a fine-grained microstructure formed as a result of the complete breaking of lamellar structures by the low-speed stirring continued for a relatively long time.

FIG. 4 also shows refined crystals though the high-speed stirring was not continued long enough.

The fine-grained microstructures in FIGS. 3 and 4 resulted from the prevention of crack formation in the cooling process that was achieved by releasing the high strain energy built up in the specimens by forced stirring.

EXAMPLE 2

Using the same apparatus as in Example 1, not lower than 99.5% pure sponge titanium and small pieces of 99.99% pure aluminum, weighing approximately 380 g in total, were mixed to obtain a mixture of Ti-49 at % Al. The mixture was put in the inner crucible 21 of calcia and processed under substantially the same conditions as in Example 1.

For the purpose of comparison, a reference specimen was prepared by allowing the molten metal to solidify spontaneously in the isothermal furnace 8 without using the stirrer.

Figure 5:
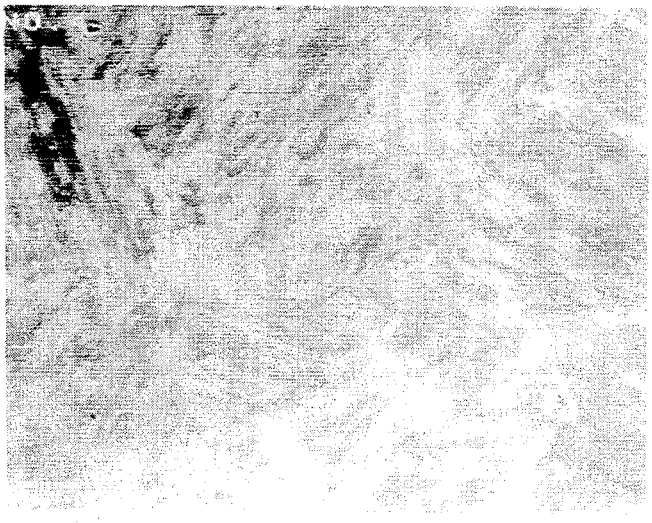
FIG. 5 is a photomicrograph of the solidified microstructure of a Ti-49 at % Al alloy prepared by a conventional process in an argon atmosphere at 800 torr.

FIG. 5 shows a photomicrograph of the solidified microstructure of a reference specimen (for comparison) of Ti-49 at % Al alloy prepared by processing the above mixture by a conventional process in an argon atmosphere at 800 torr. The obtained alloy exhibited a coarse lamellar microstructure with considerably many cavities and other casting defects.

Figure 6:
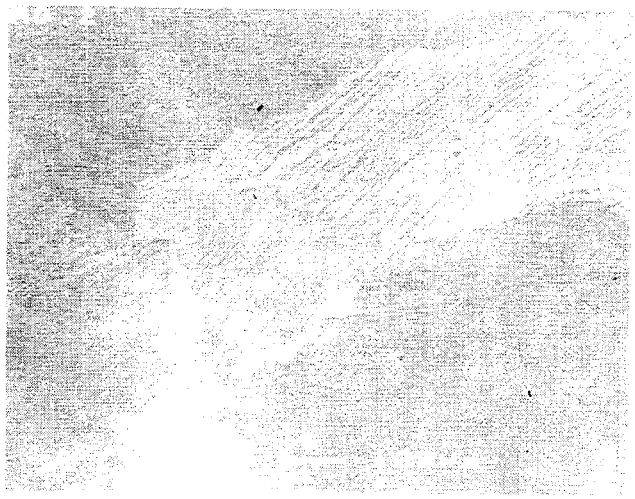
FIG. 6 is a photomicrograph of the microstructure of a Ti-49 at % Al alloy prepared in an argon atmosphere at 800 torr and allowed to solidify while being stirred with a stirrer rotating at a speed of 2200 rpm.

FIG. 6 shows a photomicrograph of the microstructure of a Ti-49 at % Al alloy prepared by processing the same mixture in an argon atmosphere at 800 torr which was allowed to solidify while being stirred with a stirrer rotated at a speed of 2200 rpm. Solidification was complete in 20 seconds after the insertion of the stirrer. On the completion of solidification, the crucible elevating mechanism was lowered to prevent the deposition of the specimen on the stirrer.

The specimen prepared with stirring at 2200 rpm exhibited a dense lamellar microstructure as shown in FIG. 6. The forced stirring relieved the high stress generated in the specimen, thus preventing the occurrence of cracking in the cooling process and permitting the formation of a fine-grained microstructure.

EXAMPLE 3

Using the same apparatus as in Example 1, not lower than 99.5% pure sponge titanium and small pieces of 99.99% pure aluminum, weighing approximately 380 g in total, were mixed to obtain a mixture of Ti-54 at % Al. The mixture was put in the inner crucible 21 of calcia and processed under substantially the same conditions as in Example 1. For the purpose of comparison, a reference specimen was prepared by allowing the molten metal to solidify spontaneously in the isothermal furnace 8 without using the stirrer.

Figure 7:
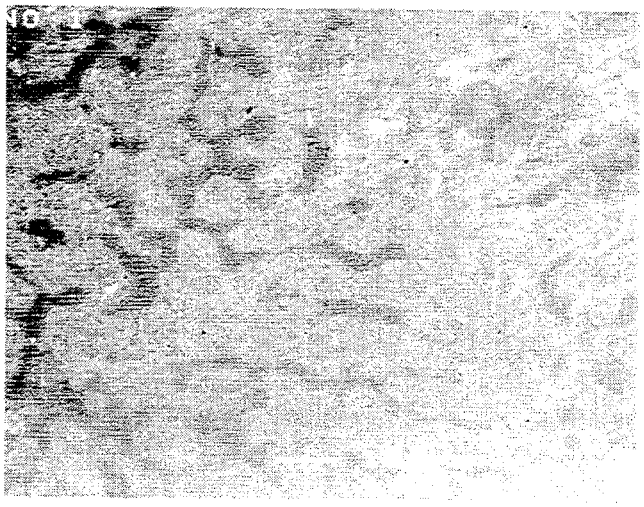
FIG. 7 is a photomicrograph of the solidified microstructure of a Ti-54 at % Al alloy prepared by a conventional process in an argon atmosphere at 800 torr.

FIG. 7 shows a photomicrograph of the solidified microstructure of a reference specimen (for comparison) of Ti-54 at % Al alloy prepared by processing the above mixture by a conventional process in an argon atmosphere at 800 torr. The obtained alloy exhibited lamellar substructure both in and between dendritic crystals.

Figure 8:
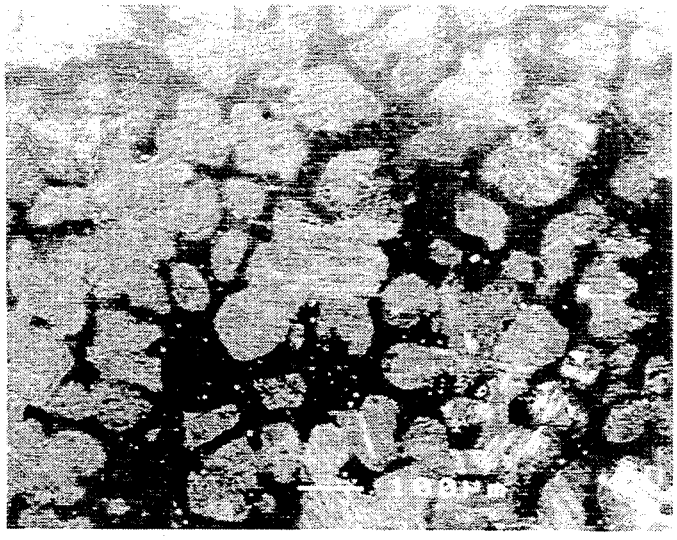
FIG. 8 is a photomicrograph of the microstructure of a Ti-54 at % Al alloy prepared in an argon atmosphere and allowed to solidify while being stirred with a stirrer rotating at a speed of 2000 rpm.

FIG. 8 shows a photomicrograph of the microstructure of a Ti-54 at % Al alloy prepared by processing the same mixture in an argon atmosphere at 800 torr which was allowed to solidify while being stirred with a stirrer rotated at a speed of 2000 rpm. Solidification was complete in 20 seconds after the insertion of the stirrer. On the completion of solidification, the crucible elevating mechanism was lowered to prevent the deposition of the specimen on the stirrer.

The specimen prepared with stirring at 2000 rpm exhibited lamellar substructures both in and between spheroidal crystals resultant from breaking of dendritic crystals by the stirring, as shown in FIG. 8. The forced stirring relieved the high stress generated in the specimen, thus preventing the occurrence of cracking in the cooling process and permitting the formation of a fine-grained microstructure.

EXAMPLE 4

Using the same apparatus as in Example 1, not lower than 99.5% pure sponge titanium, small pieces of 99.99% pure aluminum, and particles of titanium carbide measuring 1 to 2 micrometer in size, weighing approximately 370 g in total, were mixed to obtain a mixture having a nominal composition of Ti-47 at % Al+8 wt % TiC. The mixture was put in the inner crucible 21 of calcia and processed as in Example 1.

With the crucible containing the specimen placed in the high-frequency furnace 9, the chamber proper thereof was evacuated to a vacuum of not higher than $1\times10^{-5}$ torr and filled with an atmosphere of inert argon gas at approximately 800 torr. Then, the specimen was quickly melted by high-frequency heating.

The outer crucible of graphite is provided to ensure that the inner crucible is uniformly superheated in the high-frequency furnace 9 in the lower part of the vacuum chamber 1. The completion of melting of the specimen was confirmed by determining that the temperature of the side wall of the outer crucible reached 1120 ° C.

Then, the crucible cover 20 above the high-frequency furnace 9 was opened to confirm the completion of melting of the specimen by means of a check mirror. After raising the crucible 7 containing the molten specimen by means of the elevating mechanism, the stirrer 6 of titanium was put in the molten metal in the isothermal furnace 8. The lifting of the crucible was stopped when the lower end of the stirrer 6 reached 10 mm above the inner bottom of the crucible.

Then, the stirrer 6 was rotated at increasingly faster speeds, starting at a relatively lower speed of approximately 900 rpm. The ultimate stirring speed was kept at different levels of 900 rpm to 5000 rpm to prepare several different products. To minimize the out-spattering of the semi-solidified specimen from within the crucible 7, which might occur if the stirring speed increases abruptly, the rotating speed of the stirrer was increased at a steady rate.

After continuing stirring at the ultimate rotating speeds over different lengths of time chosen for the individual products, the specimen was lowered into the high-frequency furnace 9 by means of the crucible elevating mechanism at a proper time in the latter stage of solidification but not later than the completion of solidification, thus preventing the deposit of the semi-solid specimen on the stirrer 6. The specimen thus placed in the high-frequency furnace 9 was reheated at 1000 ° C. for approximately 10 minutes.

Figure 9:
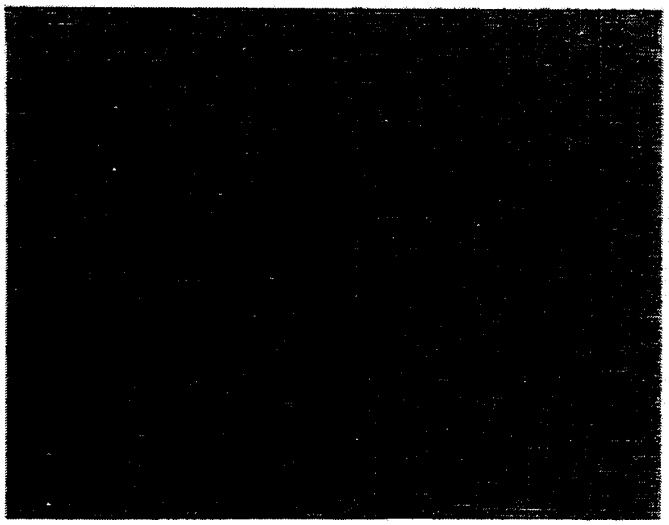
FIG. 9 is a photomicrograph of the microstructure of a Ti-47 at % Al+8 wt % TiC alloy prepared in an argon atmosphere and allowed to solidify while being stirred with a stirrer rotating at a speed of 1620 rpm.

FIG. 9 shows a photomicrograph of a Ti-47 at % Al+8 wt % TiC composite alloy prepared by melting the above specimen in an argon gas atmosphere at 800 torr, with the ultimate stirring speed fixed at 1620 rpm. After continuing stirring for 18 seconds following the insertion of the stirrer, the crucible elevating mechanism was immediately lowered to prevent the deposition of the specimen on the stirrer.

In the specimen stirred at 1620 rpm, particles of titanium carbide were relatively uniformly dispersed between the fine crystals resulting from the breaking of lamellar structure by the stirring. The forced stirring relieved the high stress generated in the specimen, thus preventing the occurrence of cracking in the cooling process and permitting the formation of a homogeneous fine-grained intermetallic compound.

What is claimed is:

1. A process for manufacturing an intermetallic compound or an intermetallic alloy thereof, which comprises the steps of:

melting a charge having the composition of an intermetallic compound or an intermetallic alloy thereof in a crucible by applying a high-frequency current in a vacuum or under an inert atmosphere in a high-frequency furnace;

transferring the crucible containing the molten charge into an isothermal furnace which is under said vacuum or under said inert atmosphere;

stirring the solidifying charge with a stirrer rotated at a speed sufficient to break the crystals which form in the charge and sufficient to result in a homogeneous fine-grained microstructure in the intermetallic compound or intermetallic alloy; and then returning the obtained compound or alloy having the homogeneous fine-grained microstructure to the high-frequency furnace for reheating in order to release the strain energy built-up therein.

2. A process for manufacturing an intermetallic matrix composite material of an intermetallic compound or an intermetallic alloy thereof by adding to the process according to claim 9 a step of adding a strengthening agent to the charge at a point between the charging of the components into the crucible and the completion of the solidification of the stirred charge.

3. A process for manufacturing an intermetallic compound, intermetallic an alloy based thereof, or an intermetallic matrix composite material thereof according to claim 1 or 2, wherein one or more of TiAl, $Ti_3Al$, $Al_3Ti$, $Nb_3Al$, $Nb_2Al$, NiAl, $Ni_3Al$, $Co_3Al$, $Co_2Nb$, $Mo_5Si_3$, $Cr_3Si$, $Cr_2Nb$, FeAl, $Al_3V$, $Al_3Nb$, $Al_3Zr$, $Mo_3Al_8$, $MoSi_2$, $Ti_5Si_3$, $Nb_5Si_3$, $Nb_2Be_{17}$, and $ZrBe_{13}$ are used as the intermetallic compound or intermetallic thereof.

4. A process for manufacturing a intermetallic matrix composite material of an intermetallic compound or an intermetallic alloy thereof according to claim 2, wherein one or more of particles or short fibers of VB, $TaB_2$, $TiB_2$, TiC, WC, NbC, ZrC, VC, TaC, SiC, $Al_2O_3$, $Y_2O_3$, $ThO_2$, AlN, BN and TiN are used as the strengthening agent.

5. A process for manufacturing a intermetallic matrix composite material of an intermetallic compound or an intermetallic alloy thereof according to claim 2 or 4, wherein the quantity of the strengthening agent added is between 0.1% and 70% by volume percentage of the intermetallic matrix composite.

6. A process for manufacturing an intermetallic compound, an intermetallic alloy thereof or an intermetallic matrix composite material thereof according to claim 1 or 2, wherein the intermetallic compound or intermetallic alloy thereof is stirred for a period of 0.1 minute to 10 minutes.

7. A process for manufacturing an intermetallic compound, an intermetallic alloy thereof or an intermetallic matrix composite material thereof according to claim 1 or 2, wherein the charge having a homogeneous fine-grained microstructure obtained by stirring is reheated in the high-frequency furnace at a temperature not more than 500° C. below the solidification temperature of the charge.

8. A process for manufacturing an intermetallic compound, an intermetallic alloy thereof or an intermetallic matrix composite material thereof according to claim 7, wherein reheating is continued for a period of 10 minutes to 10000 minutes.

9. A process for manufacturing an intermetallic compound or an intermetallic alloy thereof according to claim 1, wherein the stirrer is rotated at a speed exceeding 900 rpm.

10. The process of claim 9, wherein said stirring speed ranges from 900 to 5000 rpm.

* * * * *